United States Patent [19]

Gamberini et al.

[11] Patent Number: 4,802,394

[45] Date of Patent: Feb. 7, 1989

[54] NOTCHING DEVICE FOR STRIP WRAPPING MATERIAL

[75] Inventors: Antonio Gamberini; Silvano Boriani, both of Bologna, Italy

[73] Assignee: G.D. Società per Azioni, Bologna, Italy

[21] Appl. No.: 154,374

[22] Filed: Feb. 10, 1988

[30] Foreign Application Priority Data

Feb. 23, 1987 [IT] Italy ..... 3358 A/87

[51] Int. Cl.[4] ..... B26D 1/62; B26F 1/42

[52] U.S. Cl. ..... 83/346; 83/348; 83/659

[58] Field of Search ..... 83/346–348, 83/582, 678, 659, 699, 341, 344; 493/370, 365, 963, 930

[56] References Cited

U.S. PATENT DOCUMENTS 4,517,873 5/1985 Wilson ..... 83/346 X

FOREIGN PATENT DOCUMENTS 670171 1/1939 Fed. Rep. of Germany ..... 83/341

*Primary Examiner*—Frank T. Yost

*Assistant Examiner*—Hien H. Phan

*Attorney, Agent, or Firm*—Cushman, Darby & Cushman

[57] ABSTRACT

The notching device effects transverse cuts in strip wrapping material, and in particular, along the length of a continuous strip of transparent outer wrapping material incorporating a longitudinal tear-open ribbon, which is severed with each cut. Use is made of an incision roller fitted with at least one peripheral blade, and a pressure roller mounted rotatably to a shaft having two distinct, coaxial end sections that are carried by a support in such a way as to permit adjustment of their angular position; the shaft also has an intermediate section which is embodied skew in relation to the two end sections, and it is to this skew section that the pressure roller is mounted.

5 Claims, 1 Drawing Sheet

NOTCHING DEVICE FOR STRIP WRAPPING MATERIAL

BACKGROUND OF THE INVENTION

The invention relates to a device for making notch cuts in continuous strip wrapping material.

Whilst the notching device disclosed is suitable for making transverse cuts in continuous strip wrapping material generally, its usefulness is realized to best advantage in the art field that embraces the packaging of commodities, and in particular, packs of cigarettes, for the purpose of making transverse cuts of substantially U-shaped appearance, spaced apart at regular intervals along tear-off ribbons of the type incorporated axially into continuous strips of transparent outer wrapping material, which enable easy removal of the wrapper subsequently formed from the transparent material simply by tearing it open.

The prior art in cigarette packaging machinery, cellophane wrapping machines in particular, embraces the use of notching devices comprising a revolving incision roller, mounted rotatably to a shaft and fitted with at least one blade that projects outward substantially in a radial direction from the surface of the roller and exhibits a substantially U-shaped profile when viewed in plan.

In most conventional notching devices of the type in question, the incision roller is power driven, and positioned substantially at a tangent to the surface of a pressure roller that turns idle on a second shaft, disposed substantially parallel to the shaft of the incision roller, and is capable of shifting transversely in relation thereto through the agency of a preloading device, this normally embodied as a calibrated spring associated with the second shaft. The function of the preloading device is to control the force with which the cutting edge of the blade, or blades, is brought into contact with the surface of the pressure roller as the incision roller turns.

In operation of the notching device, a continuous strip of transparent outer wrapping material with a previously incorporated, axially disposed tear-open ribbon, is fed between the incision and pressure rollers at right angles to the relative shafts in such a way that cuts are made at regular intervals along the line of the ribbon by interaction of the single blade or blades of the incision roller with the surface of the pressure roller.

Practical experience with notching devices of the type thus described has revealed that finished cuts seldom reflect the exact same U shape as that of the blade, i.e., are seldom effected faultlessly through both the strip and the ribbon, due to less-than-perfect parallelism between the two shafts that carry the incision and pressure rollers, attributable to fit tolerances allowed in assembly, and to uneven wear on the blades. Indeed it will often happen that the finished cut exhibits one part corresponding to the curve of the letter 'U', and a further part that corresponds to one only of the straight side members of the blade.

When, at a later stage, the continuous strip is cut transversely into discrete lengths each of which will be folded to form the transparent outer wrapper of a relative pack, the sub-standard nature of the transverse cuts aforementioned gives rise to marked difficulties experienced by the consumer in lifting the severed tab of the tear-open ribbon clear of the pack, and consequently, in effecting removal of the transparent outer wrapper.

Accordingly, the object of the present invention is to embody a notching device that will be capable of overcoming this drawback. A further object of the invention is to embody a notching device that can be adjusted at any given moment, simply and readily, and without halting the production cycle, so as to obtain notches of a shape that corresponds faultlessly to the profile of the relative blade or blades.

SUMMARY OF THE INVENTION

The stated objects are realized with a notching device for strip wrapping material is disclosed. Such a device serves to effect transverse cuts along the length of a continuous strip of transparent outer wrapping material of the type incorporating a longitudinal tear-open ribbon that becomes severed with each such cut, and comprises an incision roller rotatable about a first axis and fitted with at least one peripheral blade of substantially U shape, a moving support, a shaft carried by the moving support, a pressure roller mounted rotatably to the shaft, and calibrated preload means that impinge on the support in such a way that contact between the incision roller and the pressure roller is invested with a given force.

According to the invention, the aforementioned shaft exhibits at least one distinct end section, associated with the support in such a way as to permit adjustment of the angular position of the shaft about a second axis disposed substantially parallel to the first axis, and at least one further section, about which the pressure roller is freely rotatable, aligned along a third axis that is angled in relation to the second axis.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
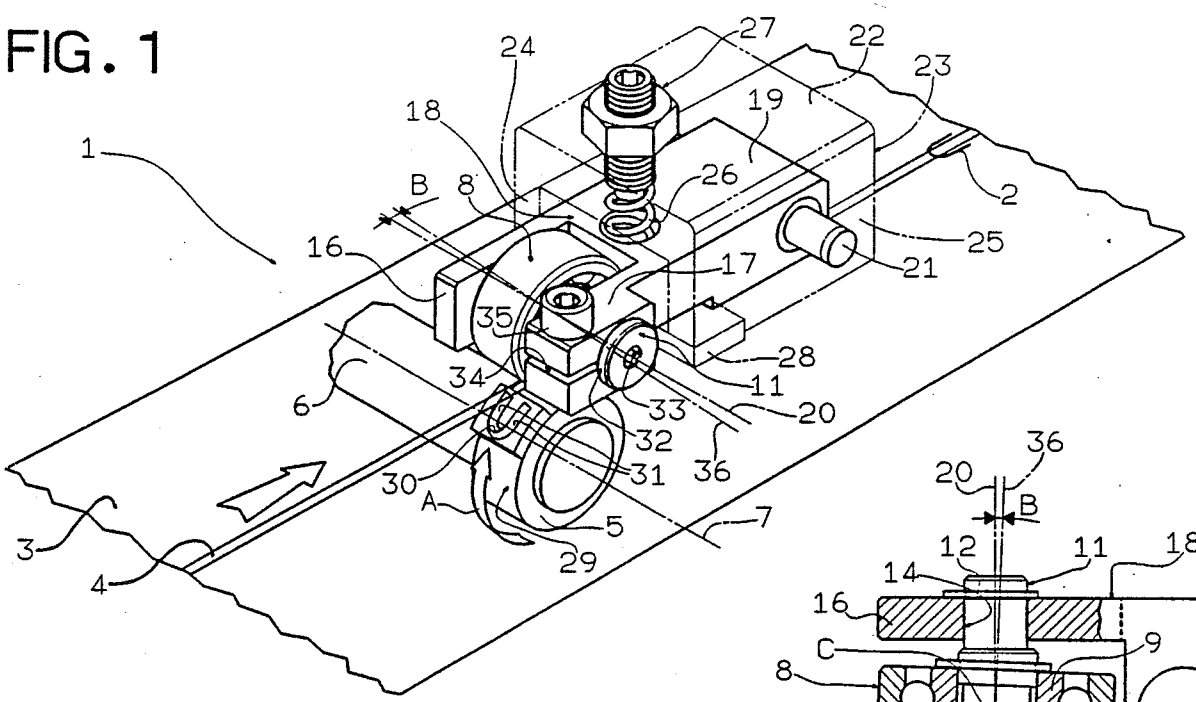
FIG. 1 is the perspective of a preferred embodiment of the notching device according to the invention.

With reference to FIG. 1 of the above drawings, 1 denotes a notching device, in its entirety, that serves to effect substantially U-shaped transverse cuts 2 at regular intervals along the length of a continuous strip 3 of wrapping material, and more exactly, each such cut 2 severs a tear-open ribbon 4 incorporated previously into the strip 3 of material and extending along it longitudinally.

The device 1 comprises an incision roller 5, keyed to a power driven shaft 6 that rotates about an axis denoted 7 and turns the roller 5 at a substantially constant speed of rotation in the direction of the arrow denoted A, and a pressure roller 8 the surface is which is disposed substantially at a tangent to the surface of the incision roller 5.

Figure 2:
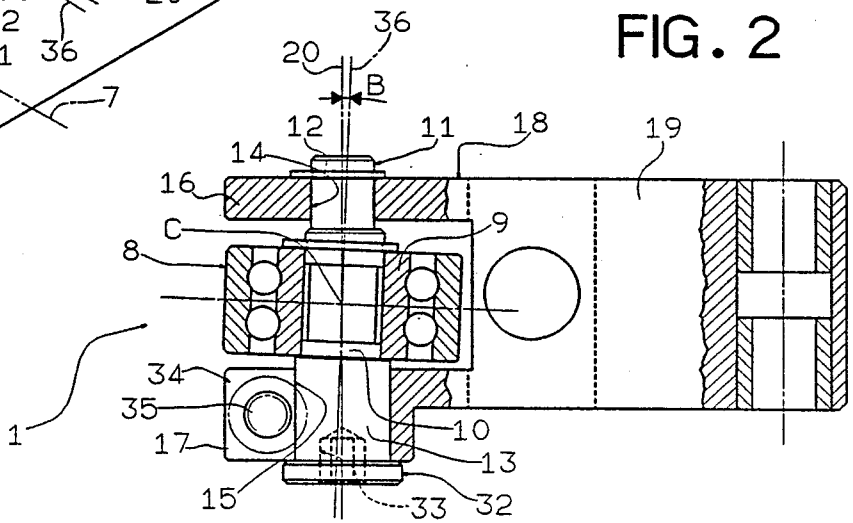
FIG. 2 shows the device of FIG. 1, viewed in plan.

It will be observed from FIG. 2 that the pressure roller 8 is mounted loose, by way of a bearing 9, to the intermediate section 10 of a shaft 11 with two distinct end sections, denoted 12 and 13, that are accommodated rotatably by respective holes 14 and 15 in the relative members 16 and 17 of a carrier which is embodied as a clevis 18 extending from the end of a support in the form of a flat plate 19.

The axes of the two holes 14 and 15 coincide with a common axis 20 that lies substantially parallel to the axis 7 aforementioned.

Returning to FIG. 1, 21 denotes a pivot, carried by the plate 19 at the end opposite from the clevis 18 and disposed substantially parallel to the two axes 7 and 20 aforementioned. The two ends of the pivot 21 pass through and are rotatably supported by relative holes (not illustrated) afforded by a fixed clevis type bracket 23 the two members of which are denoted 24 and 25. The central bridge 22 of the bracket 23 lies above the plate 19, and associates with it by way of preload means consisting in a calibrated spring 26 and an adjuster device 27 that serves to regulate the spring-loaded force impinging on the bridge 22. The member denoted 25 extends below the level of the plate 19 and carries a cross member 28 that combines with the underside of the flat plate 19 in creating a stop by means of which to impose a limit on the excursion of the selfsame plate 19 when oscillating about the axis of the pivot 21.

29 denotes the peripheral surface of the incision roller 5, which carries one or more blades 30 (one only is shown in FIG. 1); the blade projects outward, and when viewed in plan, exhibits a substantially parabolic U shape the longitudinal median plane of which is normal to the axis denoted 7. The blade 30 is positioned with the bend of the U at the trailing end, considered in the direction of the arrow A, and with its two straight members 31 one at either side of the aforesaid median plane.

It will be seen from FIG. 2 that one end section 13 of the pressure roller shaft 11 is substantially cylindrical in shape and passes through the relative member 17 of the clevis 18, terminating in a boss 32 that is similarly cylindrical, and provided at the centre with a socket 33, preferably of hex section such as to accept an Allen key (not shown); thus, it becomes possible to adjust the angular position of the shaft 11 about its axis 20, in relation to the clevis 18.

The hole 15 of the clevis member 17 in question is laid open at one side by inclusion of a diametric slot 34 that occupies a plane substantially parallel to that of the flat plate 19 and serves to split the part of the member 17 extending from the hole 15 to the extremity. 35 denotes releasable clamping means, embodied as a screw that passes through the split part of the member 17 and permits of locking the end section 13 of the shaft 11 tight in its hole 15, or allowing it to rotate about the axis denoted 20. 36 denotes the axis of the intermediate section 10 of the pressure roller shaft 11, which interconnects the two end sections 12 and 13 and is angled in relation to the axis denoted 20 in such a way that the two axes 20 and 36 intersect at a given point C coinciding, preferably, with the median plane of the pressure roller 8; more exactly, the median plane of the roller 8 is disposed normal to the skew axis 36, and the skew axis 36 forms an angle B with the axis denoted 20, hence with the axis denoted 7 (these two being parallel) which, in a preferred embodiment, will be of the order of 2°.

This special embodiment and mounting arrangment of the pressure roller shaft 11 enables a machine operator to adjust the notching device 1 at any given moment, without shutting off the machine of which it forms a part. In effect, the moment the operator becomes aware that the cuts 2 made by each blade 30 through the strip 3 and the ribbon 4 are less than perfect, all that is required is to loosen off the clamp screw 35 and release the shaft 11, then insert an Allen key into the socket 33 and rotate the shaft 11 in relation to the clevis 18, turning it to the point where a faultless cut 2 is produced.

Such an effect is obtained by virtue of the angle created between the pressure roller axis 36 and the incision roller axis 7, inasmuch as rotation of the pressure roller shaft 11 about the relative axis 20 has the effect of shifting the skew axis 36 along a conical surface, indeed a biconical surface, and thus, of altering the position of the pressure roller 8 in relation to the incision roller 5.

Accordingly, the operator can compensate at any given moment even for the slightest imperfection in contact between the periphery of the pressure roller 8 and the blades 30 simply by varying their relative positions as described, rotating the shaft 11 as little as a few degrees about its axis 20, so as to obtain a faultlessly notched cut 2 at each stroke.

With adjustment of the device 1 effected, the clamp screw 35 is retightened, and will be released again only in the event that further adjustment is needed.

Needless to say, the advantages described can also be gained with the intermediate section 10 of the shaft 11 cantilevered from one or other end 12 or 13 which, in this instance, would incorporate a device for adjustment of its angular position, i.e. the socket 33, and would be supported rotatably by a member provided with clamping means, i.e. the screw denoted 35.

What is claimed:

1. A notching device for strip wrapping material, in particular, for effecting transverse cuts along the length of a continuous strip of transparent outer wrapping material incorporating a longitudinal tear-open ribbon that is severed with each such cut, comprising:

an incision roller, rotatable about a first axis and fitted with at least one peripheral blade of substantially 'U' shape;

a moving support;

a shaft, carried by the moving support and having at least one distinct end section cooperating with the support for adjustment relative to the support of the angular position of the shaft about a second axis lying substantially parallel to the first axis, and at least one further section aligned along a third axis that is angled in relation to the second axis;

a pressure roller mounted rotatably to the section of the shaft that is aligned along the third axis;

calibrated preload means, impinging on the support in such a way that contact between the incision and pressure rollers is invested with a given force.

2. A device as in claim 1, wherein the second and third axes intersect at a point coinciding with a median plane of the pressure roller, and the median plane of the pressure roller is disposed normal to the third axis.

3. A device as in claim 1, further comprising releasable clamp means by which the shaft may be locked at a given angular position in relation to the support.

4. A device as in preceding claims, wherein:

the support comprises a clevis the two members of which flank the pressure roller on either side;

the shaft comprises two distinct end sections that are aligned coaxially and are associated with the two members of the clevis in such a way as to permit adjusting their angular position in relation thereto; and the further section of the shaft interconnects the two end sections and is angled in relation thereto.

5. A device as in claim 1, wherein the moving support is mounted pivotably in such a way as to oscillate, tensioned by the preload means, about a further axis that is disposed substantially parallel to the first axis.

* * * * *